US005586903A

United States Patent [19]

Hoffmann

[11] Patent Number: 5,586,903

[45] Date of Patent: Dec. 24, 1996

[54] PLUG CONNECTOR IN WHICH THE CABLES ARE LED OUT AT AN ANGLE AND WITH A RELEASABLE SECONDARY LOCK

[75] Inventor: Manfred Hoffmann, Reichenschwand, Germany

[73] Assignee: Framatome Connectors International, Paris, France

[21] Appl. No.: 423,102

[22] Filed: Apr. 18, 1995

[30] Foreign Application Priority Data

Apr. 25, 1994 [DE] Germany ..... 44 14 348.6

[51] Int. Cl.[6] ..... H01R 13/627; H01R 13/62

[52] U.S. Cl. ..... 439/352; 439/372

[58] Field of Search ..... 439/352, 372, 439/353, 357, 358, 953

[56] References Cited

U.S. PATENT DOCUMENTS 5,275,575 1/1994 Cahaly et al. ..... 439/352

FOREIGN PATENT DOCUMENTS 3709098 3/1987 Germany .

3619288 12/1987 Germany .

8844323.1 3/1988 Germany .

*Primary Examiner*—P. Austin Bradley

*Assistant Examiner*—Yong Kim

*Attorney, Agent, or Firm*—Pollock, Vande, Sande & Priddy

[57] ABSTRACT

A plug connector in which the cables are led out at an angle and a secondary lock, comprising a plug part (1) on which there are disposed at least two opposite tongues (2*a*, 2*b*) disposed parallel to the plug axis (3) and having outwardly pointing catches (4*a*, 4*b*), and a socket part with correspondingly arranged slots to receive the tongues (2*a*, 2*b*) and for engagement of the catches (4*a*, 4*b*) on correspondingly disposed shoulders. The tongues (2*a*, 2*b*) in the plug part (1) extend toward the back wall (5). The surfaces (6*a*, 2*b*) of the tongues (2*a*, 2*b*) oriented toward the plug axis (3) are bevelled away from the plug axis (3) toward the back wall (5). The tongues (2*a*, 2*b*) are arranged to pivot on the plug housing over substantially half their length. The back wall (5) is formed with slots (7*a*, 7*b*) in the region of the bevelled side surfaces of the tongues (2*a*, 2*b*), such that a U-shaped yoke (8), on insertion of its limbs (8*a*, 8*b*) into the slots, forces the tongues (2*a*, 2*b*) away from the plug axis (3) in this zone so that the opposite ends of the tongues (2*a*, 2*b*) are moved with the catches (4*a*, 4*b*) towards the plug axis (3).

7 Claims, 2 Drawing Sheets

PLUG CONNECTOR IN WHICH THE CABLES ARE LED OUT AT AN ANGLE AND WITH A RELEASABLE SECONDARY LOCK

FIELD OF THE INVENTION

This invention relates to a plug connector of the kind used, for example, in motor vehicle restraint systems, where maximum safety is required. For example, the power supply to the actuator of an airbag system is made via plug connections of this kind. The defined and perfect fit of the plug part in the socket part is ensured by additional tongues with catches engaging corresponding matching shoulders. After the catches have engaged, it is only with difficulty and considerable application of force that a plug part of this kind can be released from the plug connection socket part, which is usually integrated in the actuator housing. If the engaged plug is frequently released, there is also a risk that the tongues on which the catches are secured will be stretched and the catches themselves deformed, this having an adverse effect on the defined mounting and the security of the plug connection.

SUMMARY OF THE INVENTION

The object of this invention is so to improve a plug connector of the kind referred to hereinbefore that the plug connection can be released without great force being required for the purpose and without the engagement means being subject to wear.

BRIEF DESCRIPTION OF THE DRAWINGS

The invention is explained below with reference to the accompanying drawings wherein.

DETAILED DESCRIPTION

Figure 1:
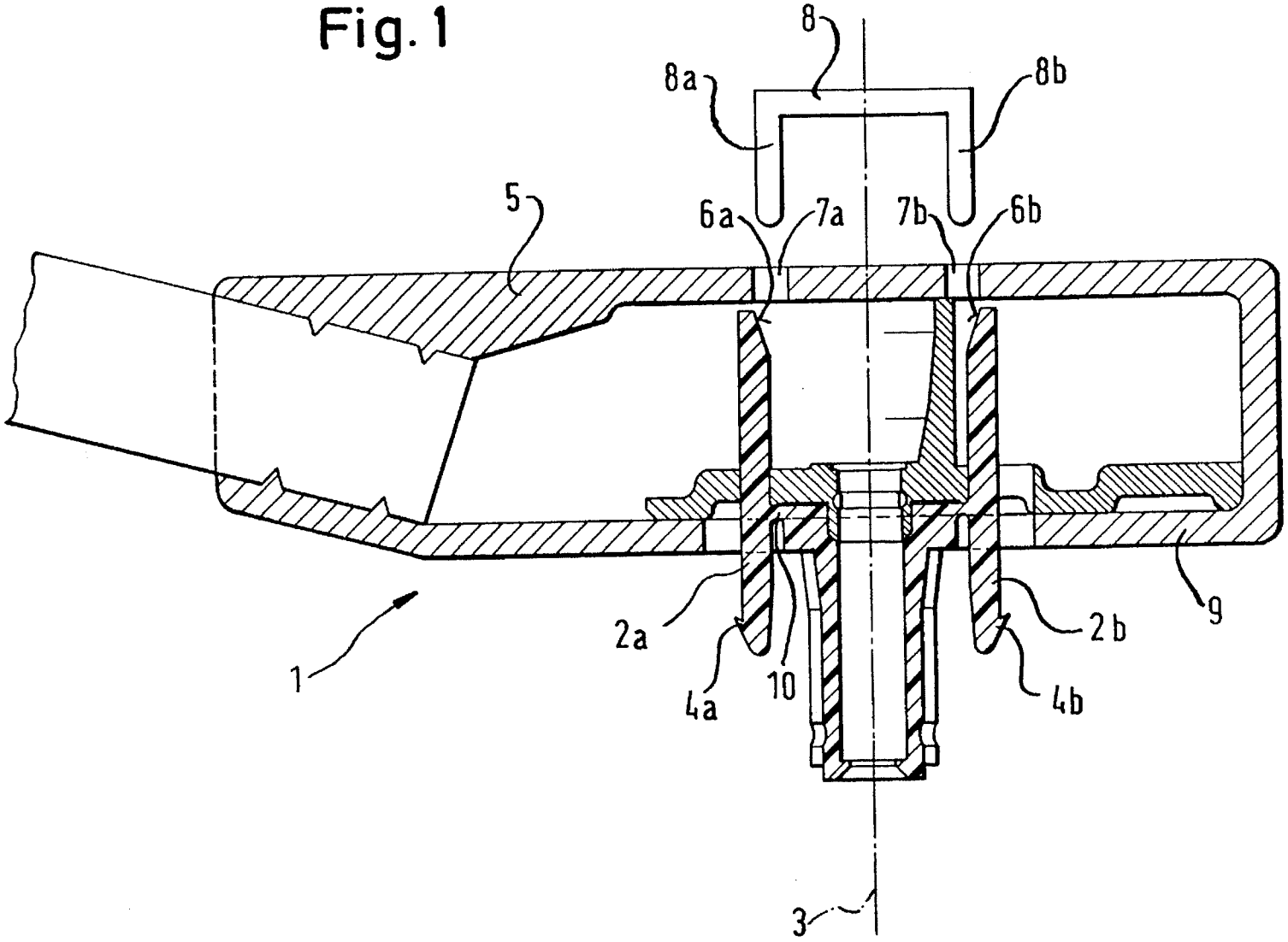
FIG. 1 shows the plug part of a first embodiment of a plug connector according to the invention.

FIG. 1 shows a section of a plug part of the plug connector according to the invention, and a U-shaped yoke for releasing the catch.

The plug part 1 of the plug connector has an axis 3, rotationally symmetrically to which an apron is formed to protect the plug contacts. The connecting cables with the plug contacts are taken out of the housing of the plug part 1 on the left-hand side. Tongues 2*a*, 2*b* with catches 4*a*, 4*b* are formed on either side of the apron, symmetrically in relation to the plug axis 3, and parallel thereto. When the plug part 1 is inserted into a socket part (not shown), the tongues with the catches are introduced into appropriate slots in the socket part and the catches 4*a*, 4*b* engage there with appropriately shaped shoulders.

The tongues 2*a*, 2*b* are not formed directly on the front walls 9 of the plug part, but extend into the plug housing, approximately as far as the plug rear wall 5 in the example illustrated. The tongues 2*a*, 2*b* are each connected to the front wall 9 of the plug part 1 via an elastically flexible web 10, the latter being connected to the tongues 2*a*, 2*b* approximately in the middle of their length.

When the ends of the tongues 2*a*, 2*b* provided with the catches 4*a*, 4*b* are biased towards one another, the tongues each pivot about the web zone 10 so that the opposite ends in the housing of the plug part 1 move away from one another. In the housing of the plug part 1, the side surfaces of the tongues 2*a*, 2*b* situated towards the plug axis 3 are so bevelled that the distance between the side surfaces increases with the approach to the back wall 5 of the plug part 1. Slots 7*a*, 7*b* approximately in alignment with the length of the tongues are provided in the rear wall 5 and through them the limbs 8*a*, 8*b* of a yoke can be introduced into the housing of the plug part 1. The parallel limbs 8*a* and 8*b* force the tongues 2*a* and 2*b* apart in the region of the rear wall 5 of the plug part 1 so that, by pivoting about the web zone 10 of the tongues' the catches 4*a*, 4*b* move towards one another and thus leave the engagement position in the plug connection socket part. The plug part 1 can thus be withdrawn from the socket part unengaged, without damage to the catches or tongues 2*a*, 2*b*.

Since the plug connection is released in the non-engaged state, the tongues and catches can be of stable construction such that it is not possible to release the plug connection other than by introduction of the U-shaped yoke 8. The latter and the slots 7*a*, 7*b* may also have a coding so as to prevent unauthorized release of the connection by a conventional tool without the appropriate yoke 8.

Figure 2:
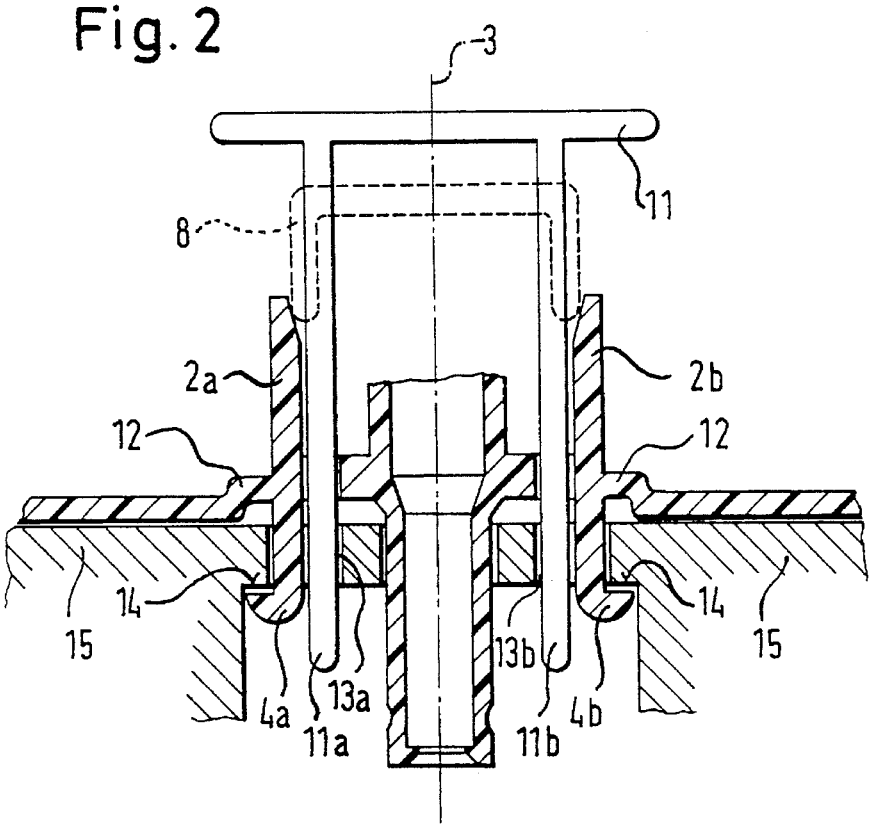
FIG. 2 shows the plug part of a second embodiment engaged in the socket part and with additional fixing.

FIG. 2 shows a second embodiment of the invention in which an additional yoke 11 is provided to block the tongues 2*a*, 2*b*. For this purpose, some modifications are necessary compared with the first embodiment. Here, the tongues 2*a*, 2*b* are again connected to the plug part housing via elastically flexible webs, but, relative to the plug axis 3' the webs are disposed externally on the tongues 2*a*, 2*b* to allow the limbs 11*a*, 11*b* to pass through the entire plug part housing as far as the slots 13*a*, 13*b* of the plug connector socket part. The limbs 11*a*, 11*b* and the slots 13*a*, 13*b* are each so dimensioned that the clearance required to allow engagement of the catches 4*a*, 4*b* is filled by the limbs 11*a*, 11*b* to an extent such that it is impossible to move the catches 4*a*, 4*b* back out of the engaged position against the shoulders 14 at the socket part 15. The yoke 11 is releasably secured in the locking position on the plug part housing and remains there until the plug is to be removed. The yoke 11 is then withdrawn and the yoke 8 shown in broken lines in FIG. 2 is inserted in the slots 7*a*, 7*b* provided for the purpose in order to release the catches from the shoulders 14.

Figure 3:
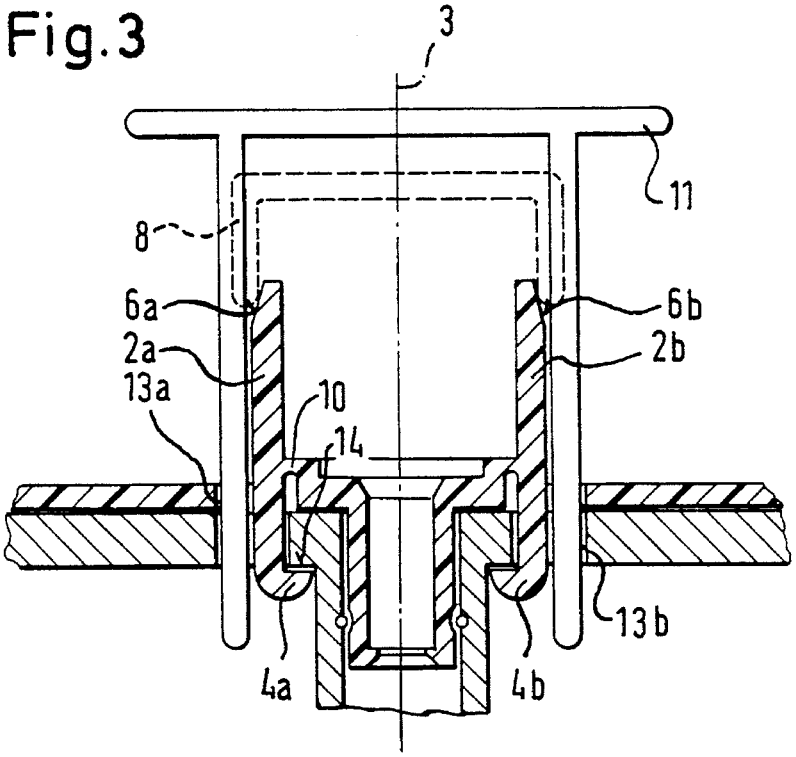
FIG. 3 shows a third embodiment with the tongues fixed.

FIG. 3 shows a third embodiment in which the orientation of the catches 4*a*, 4*b* is the reverse to that of the first and second embodiments. Here, the catches point towards the plug axis 3. The shoulders 14 and the elastically flexible web 10 are arranged accordingly. The bevelled surfaces 6*a*, 6*b* at the end of the tongues 2*a*, 2*b* remote from the catches are arranged accordingly on the outer surfaces of the tongues with respect to the plug axis' and yoke 8 is somewhat narrower than the yoke 11, so that it can be placed on the bevelled surfaces 6*a*, 6*b* instead of, like the locking yoke 11, entering the slots 13*a*, 13*b* past the outside of the tongues in order to lock the catches 4*a*, 4*b* in the engaged position.

I claim:

1. A plug connector in which cables are led out at an angle and comprising secondary locking means, said plug connector comprising:

(a) a plug part on which at least two opposite tongues are disposed parallel to an axis of said plug part, said tongues comprising outwardly directed catches;

(b) a socket part comprising slots receiving said tongues and shoulders for engagement of said catches;

(c) said tongues extending towards a back wall of said plug part;

(d) said tongues having side surfaces oriented towards said axis and being bevelled away from said axis towards said back wall;

(e) the tongues being adapted to pivot on a housing of said plug part over substantially half a length of said tongues; and (f) said back wall being formed with slots in a region of said bevelled side surfaces of said tongues in such a manner that a U-shaped yoke, upon insertion of limbs of said yoke into said slots, forces said tongues away from said axis in this zone so that said opposite ends of tongues are moved with said catches towards said axis.

2. A plug connector in which cables are led out at an angle and comprising secondary locking means, said plug connector comprising:

(a) a plug part on which at least two opposite tongues are disposed parallel to an axis of said plug part, said tongues comprising inwardly direct catches;

(b) a socket part comprising slots receiving said tongues and shoulders for engagement of said catches;

(c) said tongues extending towards a back wall of said plug part;

(d) said tongues having side surfaces oriented away from said axis and being bevelled towards said axis towards said back wall;

(e) said tongues being adapted to pivot on a housing of said plug part over substantially half a length of said tongues; and (f) said back wall being formed with slots in a region of said bevelled side surfaces of said tongues in such a manner that a U-shaped yoke, upon insertion of limbs of said yoke into said slots, forces said tongues towards said axis in this zone so that said opposite ends of said tongues are moved with said catches away from said plug axis.

3. A plug connector according to claim 1 or 2, wherein said tongues extend substantially as far as said back wall in said plug part.

4. A plug connector according to claim 1 or 2, wherein said tongues are integrally connected to a front wall of said plug part by a flexible web.

5. A plug connector according to claim 1 or 2, wherein said slots and said limbs comprise a coding.

6. A plug connector according to claim 1, including a second yoke adapted to be introduced into corresponding slots in said housing, said second yoke extending along side surfaces of said tongues facing said axis as far as corresponding slots in said socket part, said second yoke comprising limbs which prevent release of said catches from engagement with said shoulders.

7. A plug connector according to claim 2, including a second yoke adapted to be introduced into corresponding slots in said housing, said second yoke extending along exteriors of said tongues as far as corresponding slots in said socket part, said second yoke comprising limbs which prevent release of said catches from engagement with said shoulders.

* * * * *